United States Patent [19]

Steinhausser

[11] 3,963,108

[45] June 15, 1976

[54] MATRIX PRINTING HEAD

[75] Inventor: Fritz Steinhausser, Sommerda, Germany

[73] Assignee: VEB Kombinat Zentronik Sommerda/TH, Sommerda, Germany

[22] Filed: May 20, 1974

[21] Appl. No.: 471,263

[30] Foreign Application Priority Data

July 2, 1973 Germany ..... 171980

[52] U.S. Cl. ..... 197/1 R; 101/93.04

[51] Int. Cl.[2] ..... B41J 3/50

[58] Field of Search ..... 197/1 R; 101/93.04, 101/93.05

[56] References Cited

UNITED STATES PATENTS

| | | | |
|---|---|---|---|
| 2,869,455 | 1/1959 | Knutsen | 197/1 R X |
| 3,729,079 | 4/1973 | Zenner et al. | 197/1 R |
| 3,820,643 | 6/1974 | Priebs et al. | 197/1 R |
| 3,828,908 | 8/1974 | Schneider | 197/1 R |
| 3,834,506 | 9/1974 | Priebs | 197/1 R |

*Primary Examiner*—Ralph T. Rader

*Attorney, Agent, or Firm*—Nolte and Nolte

[57] ABSTRACT

A matrix printing head of the kind having a matrix of multiple elements which are operated sequentially to print characters. The head comprising a plurality of elongated, axially slidable printing elements which extend through each of a plurality of electromagnetically operated driving members which are operable to cause sliding movement of the printing elements.

2 Claims, 15 Drawing Figures

MATRIX PRINTING HEAD

This invention relates to printing heads used predominately for automatic printers.

Matrix printing heads have been known in the art for some time and two basic types exist. One has a plurality of characters and prints a complete character at a time and the other, the matrix head, has a plurality of printing elements which are operated sequentially to form a single character.

The disadvantages of printing heads of the first type are well known. A printing head for the conventional five by seven matrix requires, for example, 35 characters and the printing head for the recently introduced five by eleven matrix, suitable for special designs in lower case letters, requires as many as 55 characters.

Such a large number of printing elements results in higher manufacturing costs, greater susceptibility to error and large size and weight of the printing head. The large weight in turn poses additional demands on the transportation mechanism of the printer.

The printing head printing complete characters has, for these reasons, been displaced almost completely by the matrix printing head printing each character by sequential operation of multiple elements. The latter printing head employs only as many elements as required for the formation of a particular matrix, i.e. seven printing elements for the five by seven matrix and eleven elements for the five by eleven matrix. The adoption of this system results in simpler manufacturing methods, lesser numbers of errors and of course a very much smaller and lighter printing head.

The formation of characters by sequential operation of multiple elements is, however, only bought at the price of the greater demand on the speed of printing. While the printing head employing a plurality of complete characters needs to moved only once per printed character, the printing head printing each character by sequential operation of multiple elements is required to execute as many movements as is necessary to build up that character from a number of elements which will, for example, correspond to a maximum of five movements for the five by seven matrix. Printing heads of both types of construction use in general steel wires for guidance which are bundled together on one side to lead either to a matrix or column, and therefore required to be spaced at a minimum distance from each other. They are connected on their other side to their respective driving elements which most usually are electromagnetically operated. Since the driving elements will, of necessity, have a much larger diameter than the steel wire, it is necessary to spread these steel wires which is accomplished by an appropriate mechanical guide means. This in turn reduces the durability of the printing heads of this type as a result of the friction between the wires and the guides and of course the flexing of the wires around the guides.

Known printing heads employ steel wires of circular or square cross section and the attachment of such wires to the armature of an electro-magnetic driving element causes difficulty since such an attachment must be rigid and allows little room for tolerances, particularly insofar as any offset of the guiding elements is concerned. This places additional demands on the mechanism which in turn leads to a greater degree of wear.

A further disadvantage of steel wires used for printing is that in order to print sufficiently large elements of the matrix, the entire cross section of the wire must be used, and hence the wire must be surface-ground at its printing end and necessarily therefor has sharp edges. This, in turn, leads to adherence of the printing element either to the paper to be printed or to the printing ribbon during operation which, as the printing head is moved laterally, causes the wire to bend and this introduces the problems of increasing friction and wear of the forward guiding mechanisms and can lead to a deformation of the wires because of their relatively low resistance to bending.

Thus, this cross section is a further disadvantage of the known constructions. To limit this disadvantage, attempts have been made to limit the lateral movement of the printing element so that at the moment of impact of the printing elements or wires with the paper or ribbon, the lateral velocity of the head is zero or close to zero. However, the attempts to minimize this problem have required an additional mechanism and of course this increases the weight of the total printing mechanism and is a source of possible additional malfunctions.

It has also been proposed to avoid bending of the wires in printing heads printing a complete character at a time, and this is accomplished by feeding all printing wires through all driving elements but such a sequential arrangement of thirty-five or fifty-five driving elements is hardly practical in view of its resultant length and in any event the other disadvantages of this construction remain.

Printing heads having a matrix of elements to print each character have an electrical connection between the driving elements and the supply in the form of a flexible electrical cable tied to the printing head, or in the form of a prong attached to the printing head. The flexible cable suffers from the disadvantage that whenever the printing head is replaced because of wear, the cables must also be replaced. On the other hand, the version using prongs has the disadvantage that a change of printing heads is made difficult due to the large attachment force exerted between the prongs and the jacks to which each prong is attached.

The present invention seeks to avoid these disadvantages in a printing head of the kind having a plurality of sequentially operated printing elements.

An embodiment of the present invention is illustrated in the accompanying drawings, in which.

Figure 8:
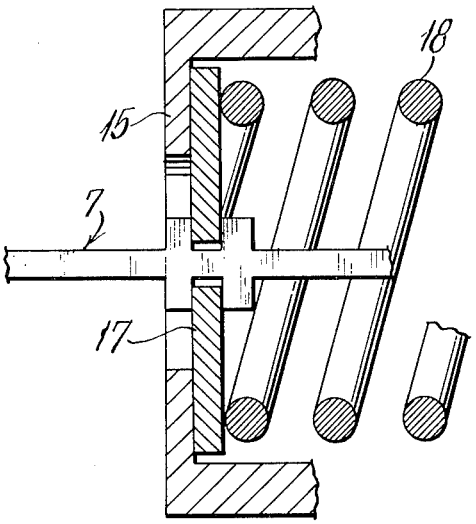
FIG. 8 is a cross sectional view showing the attachment of the slider or printing element to the electromagnetic driving element.

FIG. **8*a* is a detail of the FIG. 8** arrangement; section.

FIG. **9*b***

Figure 9:
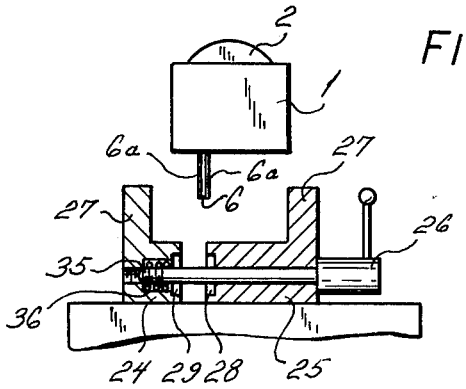

FIG. 9 shows, schematically, the pedestal for the printing head, partly in section.

Figure 9B:
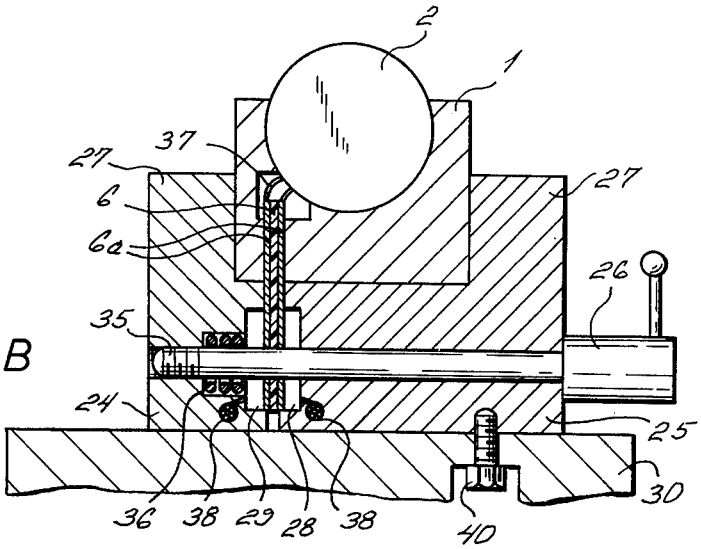
Figure 9C:
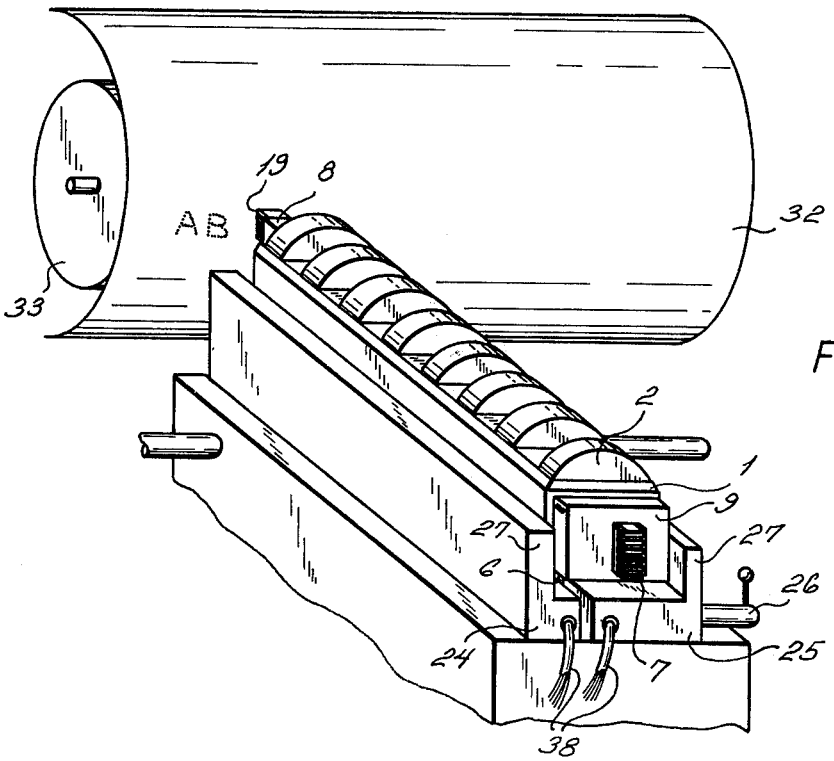

FIG. 9*b* is a view similar to FIG. 9 but on a larger scale and showing the connections between the electromagnetic driving elements and the electrical connector means, and FIG. 9*c* is a perspective view of the printing head assembly and its relationship to the printing cylinder.

Figure 5:
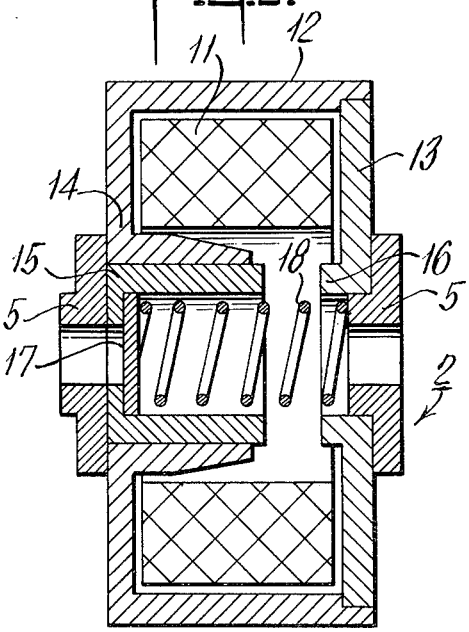
FIG. 5 is a cross section of an electro-magnetic driving element of this invention.

Referring to the drawings, the carrier 1 holds a number of driving elements which are in the form of circular electro-magnets and which are illustrated particularly in FIGS. 5 and 8. The carrier 1 consists of two asymmetrical parts 3 and 4 for facilitating assembly and disassembly. The individual driving elements 2 are magnetically insulated from each other by appropriate spacer 5. As is described in detail, infra, each coil of each driving element is connected to prongs 6. All of the prongs are positively locked between the parts 3 and 4 of the carrier 1 to permit a certain play to the prongs, particularly in a lateral direction.

Figure 1:
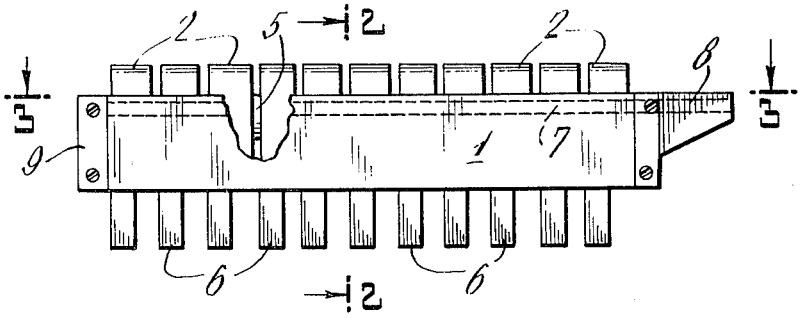
FIG. 1 shows, schematically, a partly broken away elevational view of the printing head of this invention.
Figure 2:
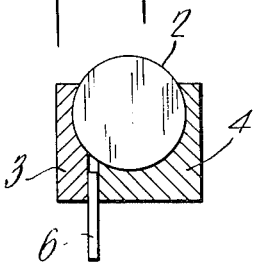
FIG. 2 is a schematic cross sectional view of the head of FIG. 1 taken along the line 2—2 of FIG. 1.

All the driving elements 2 are penetrated by a set of sliders 7 as can be seen from FIG. 1 and each slider 7 is secured to the armature of an associated driving element 2. All sliders 7 are inserted into head piece 8 and end piece 9 respectively and are guided by the latter during their sliding movement. The carrier 1 and the appropriate parts of the driving elements do not, however, provide any exact guidance for slider 7 and therefore do not cause any friction. The head piece 8, as can be seen from FIG. 2, is tapered to provide a good view of printed matter. For the same reason, the upper end of slider 7 is also made very thin.

Figure 3:
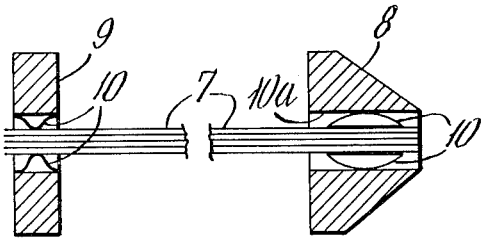
FIG. 3 is a cross section on the line 3—3 of FIG. 1.

As can also be seen in FIG. 3, both head piece 8 and end piece 9 have guide openings containing springs 10 biased to exert slight pressure on the slider and these springs are located on all four sides of the rectangular guide opening 10*a* in the head pieces and end pieces to provide effective guidance for the sliders and reduce wear on those members.

Figure 4:
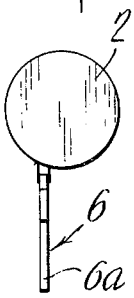
FIGS. 4 and 4A are respectively side and end views of driving elements of this invention.
Figure 4A:
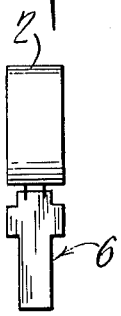

The prongs 6 and their connections for driving the element 2 is shown in FIG. 4. The coil of driving element 2 can be connected to prong 6 prior to the assembly of driving element 2 and carrier 1 since the electrical connections of the complete printing head is made or broken via prongs 6. Each prong 6 is made in the form of a cross and, in conventional manner, has an insulated plate having a lamination coating on both sides 6*a* which serves to make contact with both ends of the coil and driving element 2 and which are insulated from each other by the plate upon which they are formed and which is visible in FIG. 9*b*. The lamination coats do not extend, however, to either side thereon. Side 6*a* of prong 6 is also cut back or diminished in thickness on all other edges, particularly in the proximity of parts 3 and 4 of the carrier, to avoid contact therewith.

Driving element 2 is shown in detail in cross section in FIG. 5. Coil 11 is enclosed in a magnetic body consisting of pole piece 12 and pole plate 13. Both parts 12 and 13 exhibit rotational symmetry and pole piece 12 contains armature guiding piece 14 which also permits passage of the magnetic flux to armature 15. As will be appreciated, each element 2 has a central opening formed through armature 15, pole ring 16 and engaging piece 17 (see FIG. 8*a*) and as the elements are assembled as shown in FIG. 1, those central openings are aligned and each slider 7 extends through the opening of each driving element 2.

Figure 3A:
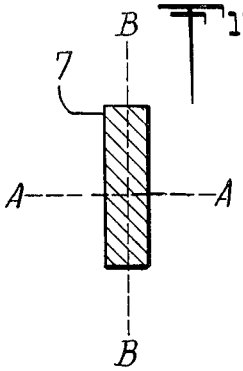
FIG. 3A is a cross section of a slider or printing element according to this invention.

The sliders 7 which preferably are made of sheet metal, have a greater resistance to bending across the minor axis of the cross section as illustrated at A—A in FIG. 3*a*, than across the major axis B—B of the same figure. Also, the sliders are rounded off at the printing tip which impacts with the ribbon or paper to reduce the adherence of the tips to the ribbon paper.

The construction here described has decided advantages over other constructions or designs, particularly when 7 or 11 driving elements 2 are mounted on carrier 1. It then becomes necessary to insure, in view of permissable tolerances of slider 7, that the resultant total tolerance is not exceeded in view of the assembly and its many driving elements 2. In order to dimension the driving element 2 properly, it is therefore advisable to specify a precise manufacturing process. The permissable dead motion of the armature, i.e. the distance between the armature at rest from the opposite pole ring 16 of pole plate 13, also determines the size of the printing head. Tolerance of this distance is fairly narrow. The present design allows both dimensions to be maintained very closely by means of simple processes. First the pole 16 and hence pole plate 13 are ground to a predetermined thickness. Pole plate 13 and pole piece 12 are assembled and pole piece 12 is also ground to a very precise dimension on the side opposite to pole plate 13. These two processes permit an exact dimensioning of the driving element 2 and contribute to reduce total dimensioning error as a result of the assembly of a number of driving elements 2 in the carrier 1. Since the armature 15 is positioned next to distance piece 5, the position of which is governed by the outer surface of pole piece 12, the armature stroke is also defined with equal accuracy. The length of the armature guiding piece 14 and the distance between the armature guiding piece 14 and pole ring 16 is of minor importance compared to the previously mentioned dimensions.

As will be apparent from FIG. 5, the armature 15 contains an engaging piece 17. Return spring 18 is situated between the engaging piece 17 and the opposite distance piece and its position is determined on one side by armature 15 and on the other side by pole ring 16.

All parts which do not interact with the magnetic flux are made either of light metal or of plastic material in order to keep the total weight of the printing head as small as possible. High efficiency of the printing head causes, in general, considerable heating of old parts and this in turn causes differential expansion of different parts of the printing head which may result in stresses or in the displacement of various parts relative to each other.

Figure 6:
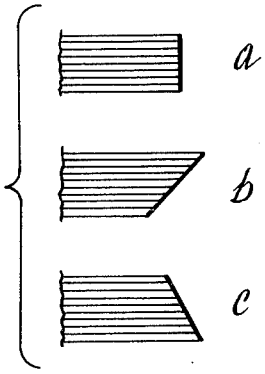
FIG. 6 illustrates schematically the alignment of the tips of the slider.

As can be seen from FIG. 1, different rates of expansion of the printing head as a result of the heating will not cause any stresses in the design according to this invention. Displacements can, however, occur if carrier 1 is made of light metal or plastic and slider 7 is made of steel if, for example, the topmost slider is attached to the most forward driving element 2 and if cold sliders 7 are aligned with their tips along a line perpendicular to their longitudinal axis as shown in FIG. 6, then a heating of the set of sliders will cause a displacement such as that shown in exaggerated form in FIG. 6*b*. This can, in turn, result in different impact forces of sliders 7 on the ribbon or paper. According to this invention, this defect can be cleared rather simply by adjusting the driving elements 2 and disposing the sliders 7 so that in their cold state the tips 19 (FIG. 7) of the sliders are aligned along the line which is inclined to a line perpendicular to their longitudinal axes, as shown in exaggerated fashion in FIG. 6*c*. This inclination is selected so that as a result of normal use of the printing head, heating causes the tips to adopt the position shown in FIG. 6*a*.

Figure 7:
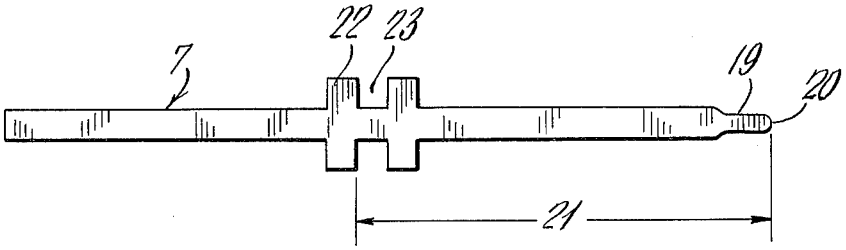
FIG. 7 is a plan view of a slider according to this invention.

The construction of slider 7 is shown in detail in FIG. 7. It is made of hard resistive material which need not be non-magnetic. For example, it may be spring steel. The strength of the steel is selected according to the size of the printing point required of it, or of the spacing between two points of the matrix for forming the characters. The tip 19 of slider 7 is both reduced and rounded off to keep the radius of curvature small so that the size of the printed point is not made unduly large when imprinting on soft material, and the small radius of curvature also serves to avoid adherence of the slider 7 to the rib in the paper.

The total length of slider 7 and the shape of tips 19 is the same for all sliders, but the distance 21 between engaging collar 22 and tip 20 for the seven or eleven sliders 7 of the printing varies, however, according to the position of the driving element 2 with which a particular slider is associated. Engaging collar 22 is formed with two slots 23 which serve to secure a positive lock of the slider 7 to the engaging piece 17 of the associated driving element.

Figure 8A:
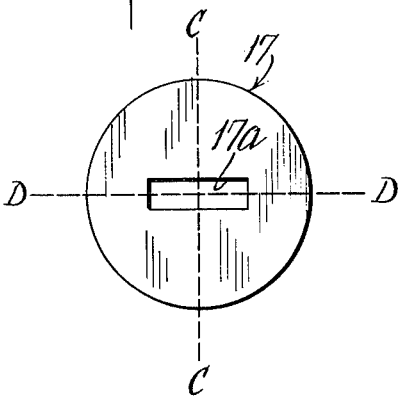
Figure 9A:
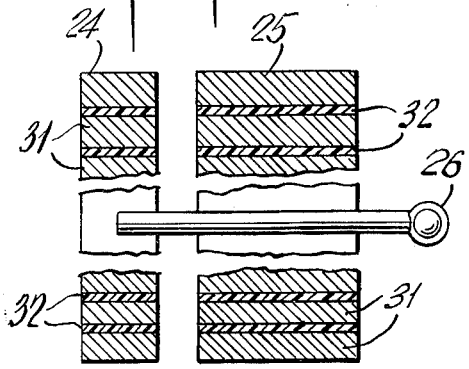

A connection of the sliders to armature 15 is shown schematically in FIGS. 8 and 8*a*. In FIG. 8*a* it is shown that engaging piece 17 is formed with a slot 17*a* having a width, shown along C—C corresponding to the width of slider 7 and height shown along D—D corresponding to the combined height of the set of seven or eleven sliders 7. Engaging pieces 17 are urged by return springs 18 toward the base of the armature and their position is therefore well defined. Each slider 7 is coupled to an associated engaging piece 17 by slots 23 and therefore each slider moves with its associated drive element while the other sliders are free to move relative to that drive element. The outer diameter of the engaging piece 17 is somewhat less than the inner diameter of armature 15 and piece 17 can therefore be slidably displaced laterally. An exact quidance of slider 7 by driving element 2 does not therefore take place.

FIGS. 9, 9*a*, 9*b* and 9*c* show the pedestal used for the attachment of the printing head. The pedestal consists of two jaws 24 and 25 capable of moving towards and away from each other and these jaws can be clamped together in the manner of a vise by means of a wrench or equivalent tool 26. This causes the opposed surfaces of jaw portions 27 to make contact with the appropriate surface of carrier 1 to establish a good heat sink.

The prongs 6 of carrier 1 are simultaneously clamped between rigid support piece 28 and resilient support piece 29. Jaws 24 and 25 are formed of sections of electrically and thermally conductive elements 31 alternating with the electrically insulating elements 32, elements 31 of one jaw contacting one conducting surface 6*a* of prongs 6 while those of the other jaw contact the other conducting surface 6*a* of prongs 6, the insulating elements 32 maintaining the electrical isolation of the prongs from each other. As can be seen in FIG. 9*b*, the electricallyconductive surfaces 6*a* of the prongs 6 are provided with leads 37 by which the connection is made to the coils of the individual electromagnets of driving elements 2 and at their ends remote from the driving elements are connected to appropriate leads 38. It is to be noted that the jaw 25 is secured to the pedestal 30 by of bolts 40.

What is claimed is:

1. A printing head comprising a plurality of flat, straight printing elements of equal length, a plurality of pot-shaped electromagnetic driving elements, each printing element being connected with a different one of said driving elements to be driven in a printing direction upon activation of that driving element to which it is connected, said driving elements being aligned and each having a central opening registering with the central openings of the others of said plurality of driving elements, and each printing element extending through the central opening of each driving element, a carrier supporting said plurality of driving elements and having a front piece and a rear piece, said front and rear pieces each having an opening registering with said central openings of said driving elements, each of said printing elements extending into said openings of said front and rear pieces, spring elements disposed in the openings of the front and rear pieces and engaging and guiding said plurality of printing elements, each driving element comprising a body, coil means, electrical connector means projecting from the body, a tubular armature, a connector element movable with the armature, return spring means associated with said armature, each said connector element constituting means connecting an associated printing element with said driving element, pedestal means comprising a pair of clamping elements disposed on opposite sides of the carrier movable toward each other to clamp an assembly of carrier, driving elements and printing elements therebetween, said clamping elements constituting heat sink means, said pedestal including electrical contact means for cooperation with said electrical connector means of said driving elements.

2. A printing head as claimed in claim 1 wherein said electrical connector elements each comprises a flat, cruciform body of insulating material having electrically conductive coatings on opposite sides thereof.

* * * * *